US008961117B2

(12) United States Patent
Garin et al.

(10) Patent No.: US 8,961,117 B2
(45) Date of Patent: Feb. 24, 2015

(54) INSULATING A CIRCUMFERENTIAL RIM OF AN OUTER CASING OF A TURBINE ENGINE FROM A CORRESPONDING RING SECTOR

(75) Inventors: Fabrice Marcel Noel Garin, Moissy Cramayel Cedex (FR); Alain Dominique Gendraud, Moissy Cramayel Cedex (FR); Gilles Jeannin, Moissy Cramayel Cedex (FR); Sebastien Jean Laurent Prestel, Moissy Cramayel Cedex (FR)

(73) Assignee: Snecma, Paris (FR)

( * ) Notice: Subject to any disclaimer, the term of this patent is extended or adjusted under 35 U.S.C. 154(b) by 309 days.

(21) Appl. No.: 13/511,021

(22) PCT Filed: Nov. 24, 2010

(86) PCT No.: PCT/FR2010/052495

§ 371 (c)(1),
(2), (4) Date: May 21, 2012

(87) PCT Pub. No.: WO2011/064496

PCT Pub. Date: Jun. 3, 2011

(65) Prior Publication Data

US 2012/0288362 A1 Nov. 15, 2012

(30) Foreign Application Priority Data

Nov. 25, 2009 (FR) ..... 09 05657

(51) Int. Cl.
*F01D 25/24* (2006.01)
*F01D 11/00* (2006.01)

(52) U.S. Cl.
CPC ..... *F01D 25/246* (2013.01); *F01D 11/005* (2013.01)
USPC ..... 415/177; 415/173.6; 415/189; 415/209.2

(58) Field of Classification Search
USPC ..... 415/170.1, 173.1, 173.4, 173.5, 173.6, 415/174.4, 174.5, 177, 189, 190, 209.2, 415/209.3, 214.111
See application file for complete search history.

(56) References Cited

U.S. PATENT DOCUMENTS 4,925,365 A * 5/1990 Crozet et al. ..... 415/173.6
5,553,999 A * 9/1996 Proctor et al. ..... 415/173.1

(Continued)

FOREIGN PATENT DOCUMENTS

EP 1 076 184 2/2001
EP 1 475 516 11/2004

(Continued)

OTHER PUBLICATIONS

International Search Report Issued Feb. 3, 2011 in PCT/FR10/52495 Filed Nov. 24, 2010.

*Primary Examiner* — Liam McDowell
(74) *Attorney, Agent, or Firm* — Oblon, Spivak, McClelland, Maier & Neustadt, L.L.P.

(57) ABSTRACT

A turbine stage of a turbine engine, the stage including a rotor wheel mounted inside a sectorized ring carried by an outer casing, the outer casing including at least a circumferential rim housed in an annular cavity to attach a downstream end of the ring sector. A bottom wall of the annular cavity of the ring sector remains radially spaced apart from the circumferential rim of the outer casing to provide a thermally insulating space between them and includes a radial positioning mechanism acting on the circumferential rim.

9 Claims, 4 Drawing Sheets

(56) References Cited

U.S. PATENT DOCUMENTS

| | | | | |
|---|---|---|---|---|
| 5,641,267 | A | 6/1997 | Proctor et al. | |
| 6,435,820 | B1 * | 8/2002 | Overberg | 415/138 |
| 6,726,391 | B1 | 4/2004 | Kreis et al. | |
| 6,733,235 | B2 * | 5/2004 | Alford et al. | 415/173.1 |
| 6,966,752 | B2 * | 11/2005 | Gieg et al. | 415/173.4 |
| 7,186,078 | B2 * | 3/2007 | Tanaka | 415/170.1 |
| 7,217,089 | B2 * | 5/2007 | Durocher et al. | 415/174.2 |
| 7,407,368 | B2 * | 8/2008 | Tanaka | 415/173.1 |
| 2004/0219011 | A1 | 11/2004 | Albers et al. | |

FOREIGN PATENT DOCUMENTS

| | | |
|---|---|---|
| FR | 2 887 920 | 1/2007 |
| FR | 2 899 273 | 10/2007 |
| FR | 2 931 197 | 11/2009 |

* cited by examiner

INSULATING A CIRCUMFERENTIAL RIM OF AN OUTER CASING OF A TURBINE ENGINE FROM A CORRESPONDING RING SECTOR

The present invention relates to a turbine stage of a turbine engine such as an airplane turboprop or turbojet.

A low-pressure turbine of a turbine engine comprises a plurality of stages, each having a nozzle formed by an annular row of stationary vanes carried by an outer casing, and a bladed wheel mounted to rotate downstream from the nozzle in a cylindrical or frustoconical envelope formed by ring sectors that are circumferentially fastened together end-to-end on the outer casing.

Hot gas under pressure leaving the combustion chamber of the turbine engine passes between the vanes of the nozzles and flows over the blades of the turbine wheels, thereby having the effect of raising the temperature of the envelopes formed by the ring sectors.

As described for example in document FR 2 899 273, in the name of the Applicant, the outer casing has at least one circumferential rim for attaching the downstream ends of the ring sectors.

In known manner, each ring sector presents a downstream end formed with an annular cavity that is defined by an upstream annular abutment, a downstream annular abutment, and a bottom wall, with the cavity being engaged on the circumferential rim of the casing, the ring sector being held in an axial position on the rim by annular abutments of the cavity.

The contact area between the circumferential rim of the casing and each of the ring sectors is large, so a large fraction of the heat of the ring is conducted to the outer casing via the circumferential rim. In operation, this may reach a temperature of about 730° C., which is the limit that can be accepted by the material used.

This leads to significant risks of the circumferential rim and the outer casing deteriorating.

A particular object of the invention is to provide a solution to this problem that is simple, effective, and inexpensive.

To this end, the invention provides a turbine stage of a turbine engine, the stage comprising a rotor wheel mounted inside a sectorized ring carried by an outer casing, each ring sector having a downstream end formed with an annular cavity defined by an upstream annular abutment, a downstream annular abutment, and a bottom wall, the outer casing having at least a circumferential rim housed in said annular cavity in order to attach the downstream end of the ring sector, the turbine stage being characterized in that the bottom wall of the annular cavity of the ring sector remains radially spaced apart from the circumferential rim of the outer casing so as to provide a thermally insulating space between them and it includes radial positioning means acting on the circumferential rim.

In this way, the contact area between the circumferential rim and each ring sector is greatly reduced, thereby limiting the heating of the circumferential rim, and more generally, the heating of the outer casing.

In an embodiment of the invention, the radial positioning means comprise at least two studs formed to project from the bottom wall of the annular cavity.

The contact area between the ring sector and the circumferential rim is thus limited to the area at the ends of the studs.

Advantageously, the studs are situated at the circumferential ends of the bottom wall.

This makes it possible to ensure that the ring sector is properly positioned relative to the circumferential rim. Nevertheless, since the circumferential expansion of the ring is greater than that of the circumferential rim, relative movement occurs between the studs and the circumferential rim when the turbine engine is in operation, thereby giving rise to friction and to wear thereof.

According to another characteristic of the invention, the studs are situated at a distance from the axial midplane of the bottom wall, so as to ensure that the ring sector is properly positioned radially.

Preferably, the studs are situated between the axial midplane and the circumferential ends of the bottom wall, so as to limit the wear of the above-mentioned elements in contact.

It is also advantageous for each annular abutment to include a radial surface extending over the entire circumference of the annular sector, the circumferential rim of the outer casing being mounted without clearance between the radial surfaces of the annular abutments of the ring sector.

This provides sealing between the circumferential rim and the ring sector.

The studs may be rectangular in shape.

It is also advantageous for the circumferential rim of the outer casing to be axially stressed between the annular abutments, so as to guarantee proper positioning of the ring sector against the outer casing.

Preferably, the ratio between the contact area of the studs and the area of the bottom wall of the annular cavity lies in the range 0.1 to 0.25.

The invention also provides a turbine engine such as an airplane turboprop or turbojet, the turbine engine being characterized in that it includes a turbine stage of the invention.

The invention can be better understood and other details, characteristics, and advantages of the invention appear on reading the following description made by way of non-limiting example and with reference to the accompanying drawings, in which.

Figure 1:
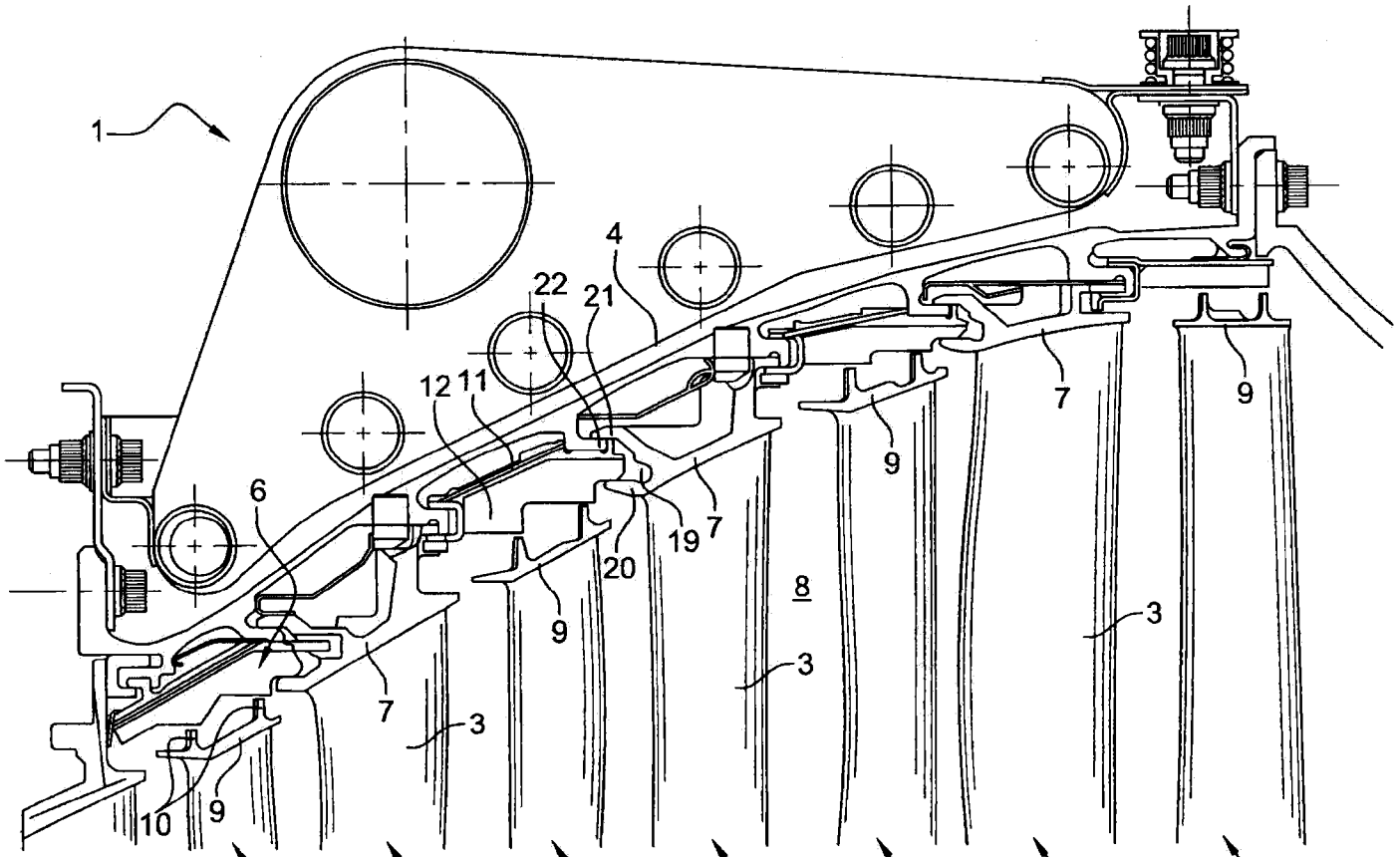
Fig. 1 Background Art
FIG. 1 is a fragmentary diagrammatic view in axial section of a prior art low-pressure turbine.
Figure 2:
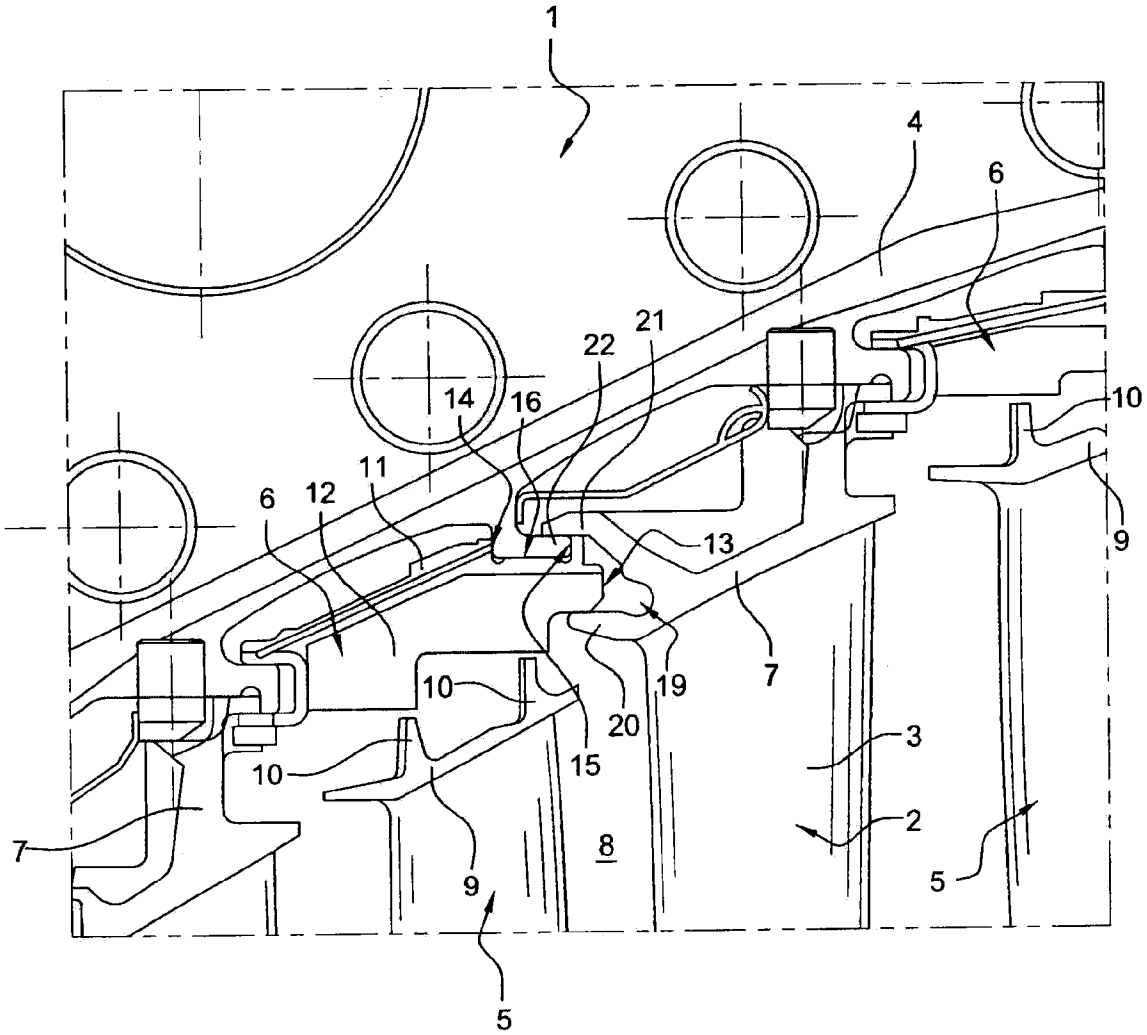
Fig. 2 Background Art
FIG. 2 is an enlarged of a portion of FIG. 1.
Figure 3:
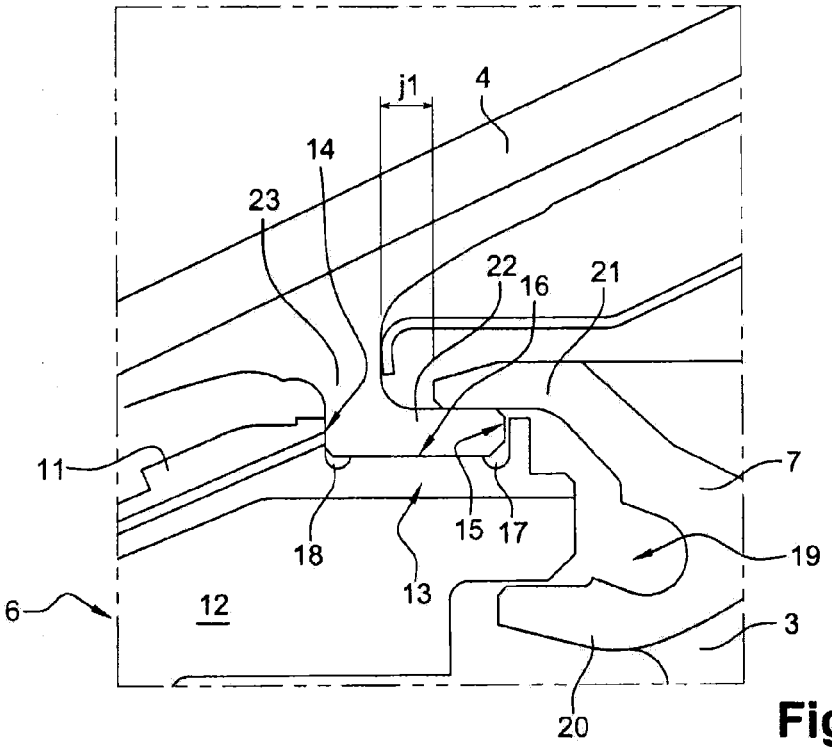
Fig. 3 Background Art
FIG. 3 is an enlarged view of FIG. 2 showing how the downstream end of a ring sector is mounted on a circumferential rim of the outer casing.

FIGS. 1 to 3 show a low-pressure turbine 1 of a prior art turbine engine comprising a plurality of stages, each having a nozzle 2 of stationary vanes 3 carried by an outer casing 4 of the turbine, and a rotor wheel 5 mounted downstream from the nozzle 2 and rotating within a substantially frustoconical envelope formed by ring sectors 6 that are carried circumferentially end-to-end by the casing 4 of the turbine.

The nozzles 2 have inner (not shown) and outer walls 7 constituting surfaces of revolution that define between them an annular passage 8 in which gas flows through the turbine, which walls are radially connected together by the vanes 3.

The rotor wheels 5 are secured to a turbine shaft (not shown) and each of them comprises an outer shroud 9 and an inner shroud (not visible), the outer shroud 9 having outer radial ribs 10 surrounded externally with a little clearance by the ring sectors 6.

Each ring sector 6 comprises a frustoconical wall 11 and a block 12 of abradable material fastened to the radially inside surface of the frustoconical wall 11 by brazing and/or welding, the block 12 being of the honeycomb type and being designed to be worn away by friction against the ribs 10 of the wheel 5 in order to minimize the radial clearance between the wheel 5 and the ring sectors 6.

The frustoconical wall 11 of the ring sector presents a downstream end 13 formed with an outwardly-open annular cavity that is defined by an upstream annular abutment 14, a downstream annular abutment 15, and a bottom wall 16. Each annular abutment 14, 15 has a surface extending over the entire circumference of the ring sector 6. The bottom wall 16 also presents a downstream annular groove 17 and an upstream annular groove 18 that enable the cavity to be machined (see FIG. 3).

The downstream end 13 of each ring sector 6 is engaged in an annular space 19 defined between two annular rims of the outer wall 7 of the nozzle 2 that is situated downstream, respectively a radially inner rim 20 and a radially outer rim 21 that face upstream.

The outer casing 4 includes an internal circumferential rim 22 of section in the shape of a hook facing downstream, engaged in the cavity of the frustoconical wall 11 of the annular sector and held therein by the radially outer rim 21 of the nozzle 2. The circumferential rim 22 of the outer casing 4 is stressed axially between the annular abutment 14, 15 of the ring sector 6, with this stress remaining during all operating stages of the turbine engine.

More particularly, said rim 22 presents a radially outer annular surface that comes to bear against the radially outer rim 21 of the nozzle and a radially inner annular surface that bears against the bottom wall 16 of the ring sector.

Axial clearance j1 is provided between the upstream end of the radially outer rim 21 and the connection zone 23 between the rim 22 and the outer casing 4. This clearance serves to compensate for the effects of expansion and it may become practically zero while the turbine engine is in operation.

At its downstream end 13, the ring sector 6 is thus locked against the circumferential rim 22 of the casing by the nozzle 2, sealing between the circumferential rim 22 and the ring sector 6 being provided by the axial abutments 14, 15 and by the bottom wall 16.

The ring sector 6 is also attached at its upstream end to the casing by means of a structure that is not described in detail herein.

In operation, the gas from the combustion chamber heats the ring sectors 6 with the heat then being transmitted by conduction to the circumferential rim 22 of the casing.

Unfortunately, the conduction area or contact area between the ring sector 6 and the circumferential rim 22 is large, such that, in practice, the temperature of the rim 22 can reach a limit value, e.g. 730° C., i.e. the maximum acceptable temperature for the material that is conventionally used.

Figure 4:
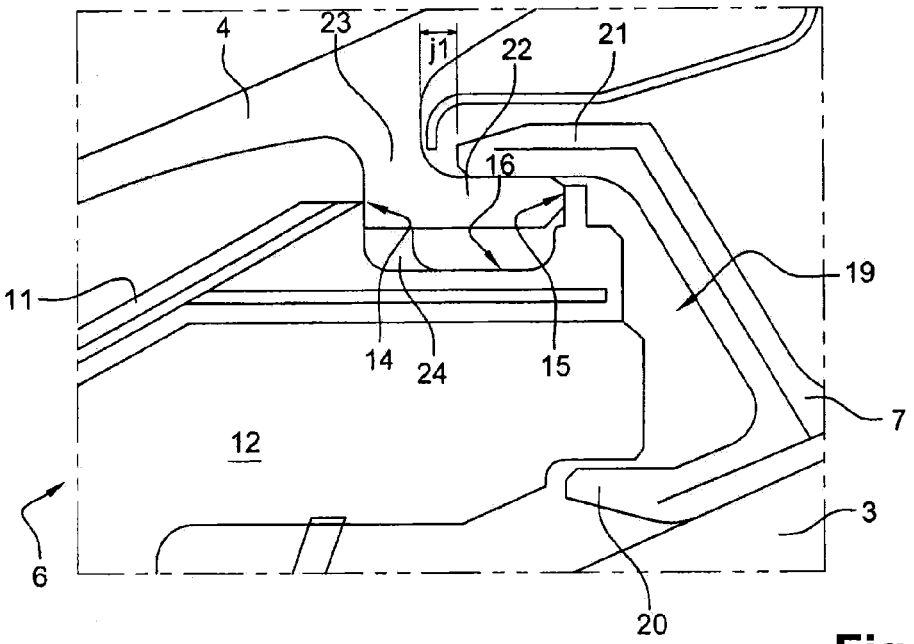
FIG. 4 is a view corresponding to FIG. 3 and showing the invention.
Figure 5:
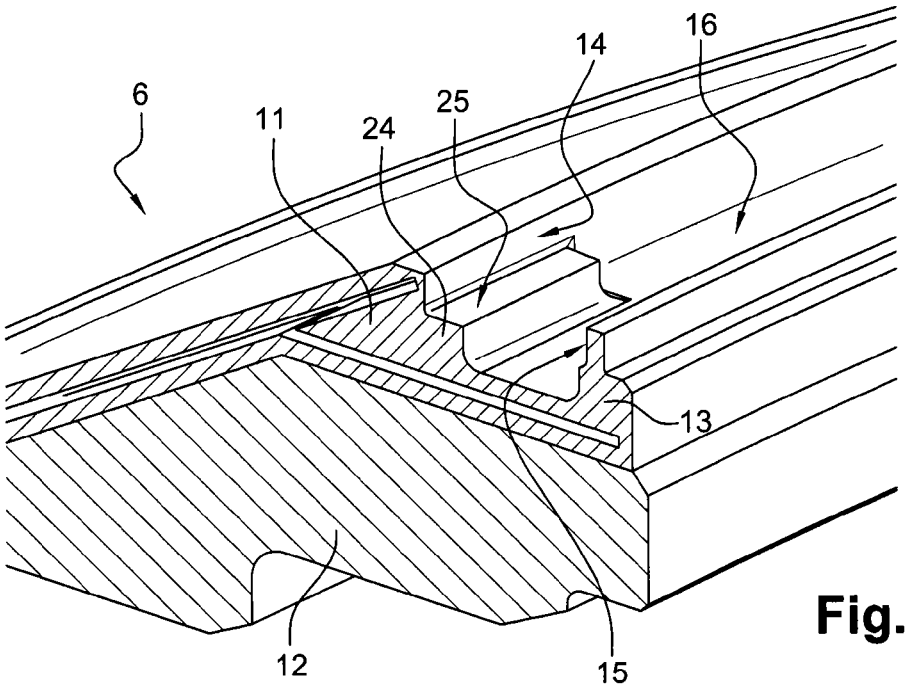
FIG. 5 is a fragmentary view in perspective of a ring sector of the invention.
Figure 6:
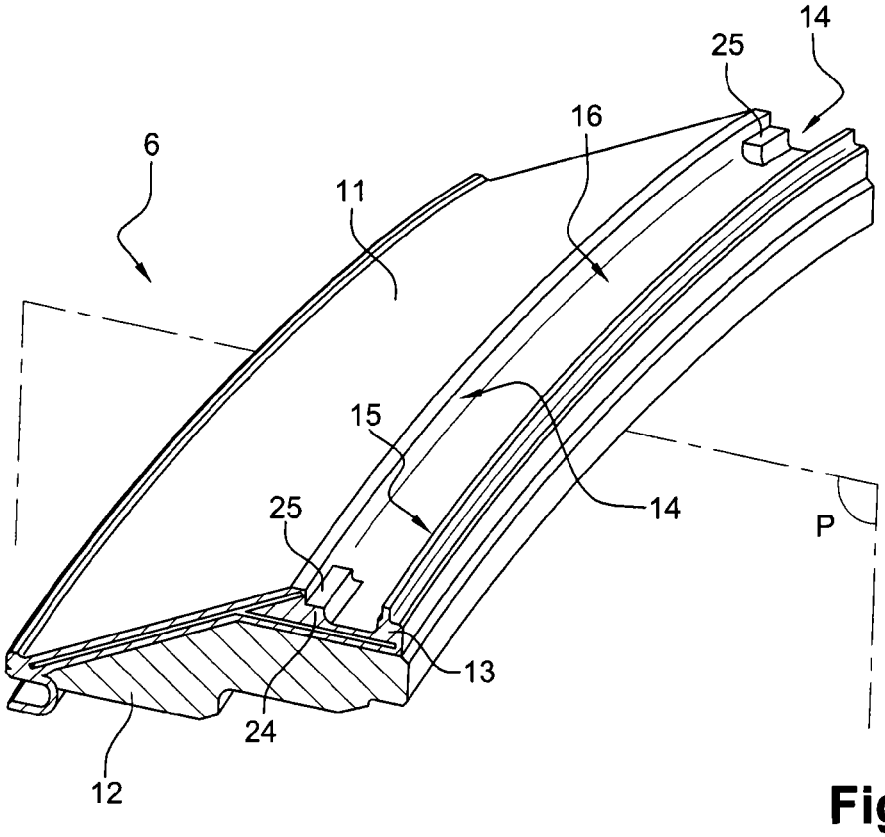
FIG. 6 is a perspective view of the FIG. 1 ring sector.

A ring sector of the invention is shown in FIGS. 4 to 6. It differs from the sector described above in that the bottom wall 16 of the annular cavity includes at least two studs 24 projecting radially outwards, the ends of the studs forming bearing surfaces 25 against the circumferential rim 22. The studs 24 are preferably arranged in the proximity of the upstream abutment 14 of the ring sector 6.

In this way, the contact area between the circumferential rim 22 and the ring sector 6 is reduced and a sheet of insulating air is formed between the bottom 16 and the inner wall of the circumferential rim 22.

The ratio between the contact area of the studs 24 and the area of the bottom wall 16 lies in the range 0.1 to 0.25.

In practice, such a structure makes it possible to reduce the temperature of the circumferential rim 22 by about 40° C. while the turbine engine is in operation.

In the embodiment of FIGS. 5 and 6, the studs 24 are of rectangular shape and they are situated at the circumferential ends of the bottom wall 16.

The studs 24 are preferably situated at a distance from an axial midplane P of the bottom wall 16, on either side thereof, being located between the axial midplane P and one of the circumferential ends of the bottom wall 16. Since each ring sector is prevented from moving circumferentially relative to the casing by means situated in its midplane P, it expands relative to the casing on either side of the midplane P. By approaching the studs 24 closer to the plane P, the amount of friction between the studs and the circumferential rim 22 of the casing is also reduced. Situating the studs remote from the plane P ensures good radial positioning of the ring sector against the circumferential rim 22 while avoiding any risk of the ring sector tipping from one side or the other of the midplane P.

Furthermore, the studs 24 may have any other desired shape, for example they may be square, cylindrical, frustoconical, etc.

The invention claimed is:

1. A turbine stage of a turbine engine, the stage comprising:

a rotor wheel mounted inside a sectorized ring carried by an outer casing, each ring sector including a downstream end formed with an annular cavity defined by an upstream annular abutment, a downstream annular abutment, and a bottom wall, the outer casing including at least a circumferential rim housed in the annular cavity to attach the downstream end of the ring sector, wherein the bottom wall of the annular cavity of the ring sector remains radially spaced apart from the circumferential rim of the outer casing to provide a thermally insulating space between them and includes radial positioning means acting on the circumferential rim, the positioning means being formed by at least two studs projecting from the bottom wall of the annular cavity.

2. A turbine stage according to claim 1, wherein the studs are situated at circumferential ends of the bottom wall.

3. A turbine stage according to claim 1, wherein the studs are situated at a distance from an axial midplane of the bottom wall.

4. A turbine stage according to claim 3, wherein the studs are situated between an axial midplane and circumferential ends of the bottom wall.

5. A turbine stage according to claim 1, wherein each annular abutment includes a radial surface extending over an entire circumference of the ring sector, the circumferential rim of the outer casing being mounted without clearance between radial surfaces of the annular abutments of the ring sector.

6. A turbine stage according to claim 5, wherein the circumferential rim of the outer casing is axially stressed between the annular abutments.

7. A turbine stage according to claim 1, wherein the studs are of rectangular shape.

8. A turbine stage according to claim 1, wherein the ratio between a contact area of the studs and an area of the bottom wall of the annular cavity is in a range of 0.1 to 0.25.

9. A turbine engine, an airplane turboprop, or a turbojet comprising a turbine stage according to claim 1.

* * * * *